US009812749B2

(12) United States Patent
Faulkner

(10) Patent No.: US 9,812,749 B2
(45) Date of Patent: Nov. 7, 2017

(54) AROUND THE MAST ROTARY COUPLER HAVING STATOR AND ROTOR POWER DIVIDERS/COMBINERS THAT ARE AXIALLY STACKED

(71) Applicant: Continental Microwave and Tool Co., Inc., Exeter, NH (US)

(72) Inventor: Glenn David Faulkner, Groveland, MA (US)

(73) Assignee: Continental Microwabe and Tool Co., Inc., Exeter, NH (US)

( * ) Notice: Subject to any disclaimer, the term of this patent is extended or adjusted under 35 U.S.C. 154(b) by 354 days.

(21) Appl. No.: 14/833,249

(22) Filed: Aug. 24, 2015

(65) Prior Publication Data

US 2017/0098876 A1 Apr. 6, 2017

Related U.S. Application Data

(60) Provisional application No. 62/088,947, filed on Dec. 8, 2014.

(51) Int. Cl.
*H01P 1/06* (2006.01)
*H01P 5/12* (2006.01)

(52) U.S. Cl.
CPC ..... *H01P 1/068* (2013.01); *H01P 1/067* (2013.01); *H01P 5/12* (2013.01)

(58) Field of Classification Search
CPC .. H01P 1/06; H01P 1/062; H01P 1/066; H01P 1/068; H01P 1/069; H01P 1/067
USPC ..... 333/256, 257, 261
See application file for complete search history.

(56) References Cited

U.S. PATENT DOCUMENTS 3,123,782 A * 3/1964 Parisi ..... H01P 1/068 310/232
3,199,055 A * 8/1965 Keen ..... H01P 1/068 333/263
3,914,715 A 10/1975 Hubing et al.
4,543,549 A * 9/1985 Meltzer et al. ..... H01P 1/068 333/24 C
5,233,320 A * 8/1993 Evans ..... H01P 1/068 333/261

* cited by examiner

*Primary Examiner* — Benny Lee
(74) *Attorney, Agent, or Firm* — Bond, Schoeneck & King, PLLC; Jeremy Oczek; Amanda Lippes

(57) ABSTRACT

A radio frequency rotary coupler with its power dividers/couplers separated among multiple circuit layers that are axially stacked and interconnected using coaxial feeds. This architecture allows for multiple layers of circuits with minimal outside diameter and while minimizing increase in axial length. The coupler includes a stator, rotor, and dynamic capacitive ring. The stator includes at least a first stator circuit layer with a primary stator power divider (SPD), a second stator circuit layer with at least one secondary SPD, and stator coaxial feeds coupling the primary SPD and the secondary SPD(s). The rotor includes a first rotor circuit layer with a primary rotor power divider (RPD), a second rotor circuit layer with at least one secondary RPD, and rotor coaxial feeds coupling the primary RPD and the secondary RPD(s). The dynamic capacitive ring couples the stator and the rotor via the secondary SPD(s) and RPD(s).

10 Claims, 7 Drawing Sheets

AROUND THE MAST ROTARY COUPLER HAVING STATOR AND ROTOR POWER DIVIDERS/COMBINERS THAT ARE AXIALLY STACKED

RELATED APPLICATION

This application claims the benefit of U.S. Provisional Patent Application Ser. No. 62/088,947, filed Dec. 8, 2014, the entirety of which is hereby incorporated by reference.

BACKGROUND OF THE INVENTION

Radio frequency (RF) communication systems have practical applications in the military, commercial aircraft industry, and telecommunication industry. Mechanically rotating antennas are utilized in a variety of radar systems, such as, aircraft surveillance systems, on board ships, and on land-mounted radar installations. Because an antenna rotates, and an RF transmitter does not, connectivity between the transmitter and the rotating antenna is critical to system performance. RF rotary couplers are commonly used to transfer the RF energy between the stationary and rotating components.

In order to build multichannel rotary couplers it may be necessary to stack individual channels on top of one another. To connect those channels from the stationary side to the rotating side of a parent multi-channel assembly, coaxial cables may be run up the axis of a rotary coupler. The stacked channels may have a through hole or channel down the middle of each module. Modules of this type are called "hollow shaft" or "around the mast" modules. For example, in order for the RF energy to be transmitted between the rotating and stationary sections of a rotary coupler, the energy may be fed onto a dynamic capacitive ring within a matched RF cavity (the dynamic capacitive ring is the section of the rotary joint that allows it to turn and also pass RF energy across the rotating section). Existing corporate feed assemblies used within hollow shaft modules are constructed radially, with the number of power feeds doubling with each additional circuit path. Thus, there is often a direct relationship between frequency, ring diameter, and the number of required coaxial feeds. The number of feeds that may be used to propagate RF energy to the dynamic capacitive ring increases with the diameter of the ring and the frequency. Thus, the diameter of the ring may be directly related to the size of the through-hole to pass ancillary cables from surrounding channels. For example, to construct a hollow shaft module with a through-hole or channel of 0.175 inch diameter that can carry an X-Band signal may include a 0.500 inch diameter capacitive ring. Feeding that ring may require eight individual feeds per ring (one rotor ring, one stator ring). Using existing design geometry, this may include three radially-placed power divider circuits to create eight feed paths, which, in turn, requires a relatively large housing diameter.

FIG. 1 is a schematic diagram illustrating a view of an example previous radio frequency rotary coupler 100. As described above, in order for RF energy to be transmitted between the rotating and stationary sections of a rotary coupler 100, the energy is often fed onto a dynamic capacitive ring. In prior approaches, corporate feed assemblies are constructed radially, with the number of power feeds doubling with each additional circuit path. In the example previous radio frequency rotary coupler of FIG. 1, the RF energy is fed from the stator 105 onto a dynamic capacitive ring 205 (FIG. 2) using eight coaxial power feeds 210*a*-210*h* (FIG. 2), and fed to the rotor 110 using a corresponding eight coaxial feeds 215*a*-215*h* (FIG. 2). Dividing the RF power from a stator input 115 to the eight stator feeds 210*a*-210*h* (FIG. 2) is accomplished on the stator side using a primary power divider/combiner 120, two secondary power dividers/combiners (not shown), and four tertiary power dividers/combiners (not shown). The RF energy is then passed across the dynamic capacitive ring 205 to the eight rotor feeds 215*a*-215*h*. On the rotor side, the power is then combined from the eight rotor feeds 215*a*-215*h* using four tertiary power dividers/combiners 135*a*-135*d*, two secondary power dividers/combiners 130*a*, 130*b*, and a primary power divider/combiner 125. The RF energy is then passed to the rotor feed 140. It should be understood that power can flow either from the stator side to the rotor side, or from the rotor side to the stator side. A given power divider/combiner acts either as a power divider or a power combiner depending on the direction of such energy flow, as should be understood by one of ordinary skill in the art. For the sake of convenience and readability, a power divider/combiner may be referred to herein simply as either a "power divider" or "power combiner."

FIG. 2 is a schematic diagram illustrating another view of the example previous radio frequency rotary coupler 100 of FIG. 1. FIG. 2 provides a better view of the dynamic capacitive ring 205, the eight stator feeds 210*a*-210*h*, and the eight rotor feeds 215*a*-215*h*.

FIG. 3 is a simplified schematic diagram illustrating one side of the example previous radio frequency rotary coupler 100 of FIG. 1. For a given side of the previous radio frequency rotary coupler 100 (either the stator 105 (FIGS. 1 & 2) or rotor 110 side), the power divider components can be schematically shown as in FIG. 3. For simplicity, FIG. 3 shows the rotor 110 side. The example rotor side includes a primary power divider 125, two secondary power dividers 130*a*, 130*b*, four tertiary power dividers 135*a*, 135*b*, 135*c*, and 135*d*, and eight rotor feeds 215*a*, 215*b*, 215*c*, 215*d*, 215*e*, 215*f*, 215*g*, and 215*h*, each coupled as shown using appropriate circuitry. As can be seen in FIG. 3, the amount of area needed on the dielectric support to accommodate the circuitry according to this design can be large.

SUMMARY OF THE INVENTION

Using a linear corporate feed approach with at least one radial power divider layer, the housing diameter for RF rotary couplings can be reduced significantly. Each layer of power dividers can be placed on its own circuit layer. These layers may then be axially stacked and interconnected using coaxial feeds. This architecture allows for multiple layers of circuits with minimal outside diameter. Due to the interlocking nature of the circuit layer components, increase in axial length is minimized. This configuration allows for much smaller packaging of multiple channels, which in turn allows for the downsizing of surrounding components and ancillary equipment. For example, the outside diameter of dielectric supports using the disclosed configuration can be decreased by at least 55%. The cylindrical area occupied by the disclosed design geometry may be 30% of the original design. This is a tremendous benefit for air-borne and space-borne equipment where size and weight concerns are prevalent.

One example embodiment of the present invention is a radio frequency rotary coupler including a stator, rotor, and dynamic capacitive ring. The stator includes a plurality of stator circuit layers and a plurality of stator power dividers (SPDs), where each SPD is mounted on a particular one of the stator circuit layers. The SPDs include at least a primary SPD, a secondary SPD, and a tertiary SPD. The stator also includes a stator coaxial feed set connecting and extending from the primary SPD to the tertiary SPD via the secondary SPD, and where the stator circuit layers are stacked axially and interconnected using the stator coaxial feed set. The rotor includes a plurality of rotor circuit layers and a plurality of rotor power dividers (RPDs), where each RPD is mounted on a particular one of the rotor circuit layers. The RPDs include at least a primary RPD, a secondary RPD, and a tertiary RPD. The rotor also includes a rotor coaxial feed set connecting and extending from the primary RPD to the tertiary RPD via the secondary RPD, and where the rotor circuit layers are stacked axially and interconnected using the rotor coaxial feed set. The dynamic capacitive ring rotatably couples the stator and the rotor via the tertiary SPD and the tertiary RPD.

In many embodiments, a stator feed is connected to the primary SPD, and a rotor feed is connected to the primary RPD. Due to the space-saving advantages of the disclosed embodiments, the stator circuit layers and the rotor circuit layers can be housed within dielectric supports having an outside diameter less than one inch.

Another example embodiment of the present invention is a radio frequency rotary coupler including a stator, rotor, and dynamic capacitive ring. The stator includes (a) a first stator circuit layer with a primary stator power divider (SPD), (b) a second stator circuit layer with at least one secondary SPD, (c) at least one tertiary SPD, (d) stator coaxial feeds coupling the primary SPD and the secondary SPD(s), and (e) stator coaxial feeds coupling the secondary SPD(s) and the tertiary SPD(s). The rotor includes (a) a first rotor circuit layer with a primary rotor power divider (RPD), (b) a second rotor circuit layer with at least one secondary RPD, (c) at least one tertiary RPD, (d) rotor coaxial feeds coupling the primary RPD and the secondary RPD(s), and (e) rotor coaxial feeds coupling the secondary RPD(s) and the tertiary RPD(s). The dynamic capacitive ring couples the stator and the rotor via the tertiary SPD(s) and RPD(s).

In many embodiments, the primary SPD, secondary SPD(s), primary RPD, and secondary RPD(s) are housed in dielectric supports. The dielectric supports housing the SPDs can be stacked axially on the stator side of the coupler, and the dielectric supports housing RPDs can be stacked axially on the rotor side of the coupler. In some embodiments, each secondary SPD and secondary RPD may be housed in a corresponding individual dielectric support.

Another example embodiment of the present invention is a radio frequency rotary coupler including a stator, rotor, and dynamic capacitive ring. The stator includes (a) a first stator circuit layer with a primary stator power divider (SPD), (b) a second stator circuit layer with at least one secondary SPD, and (c) stator coaxial feeds coupling the primary SPD and the secondary SPD(s). The rotor includes (a) a first rotor circuit layer with a primary rotor power divider (RPD), (b) a second rotor circuit layer with at least one secondary RPD, and (c) rotor coaxial feeds coupling the primary RPD and the secondary RPD(s). The dynamic capacitive ring couples the stator and the rotor via the secondary SPD(s) and RPD(s).

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows. The description illustrates the disclosed configuration and demonstrates the downsizing capability of the new design.

Figure 1:
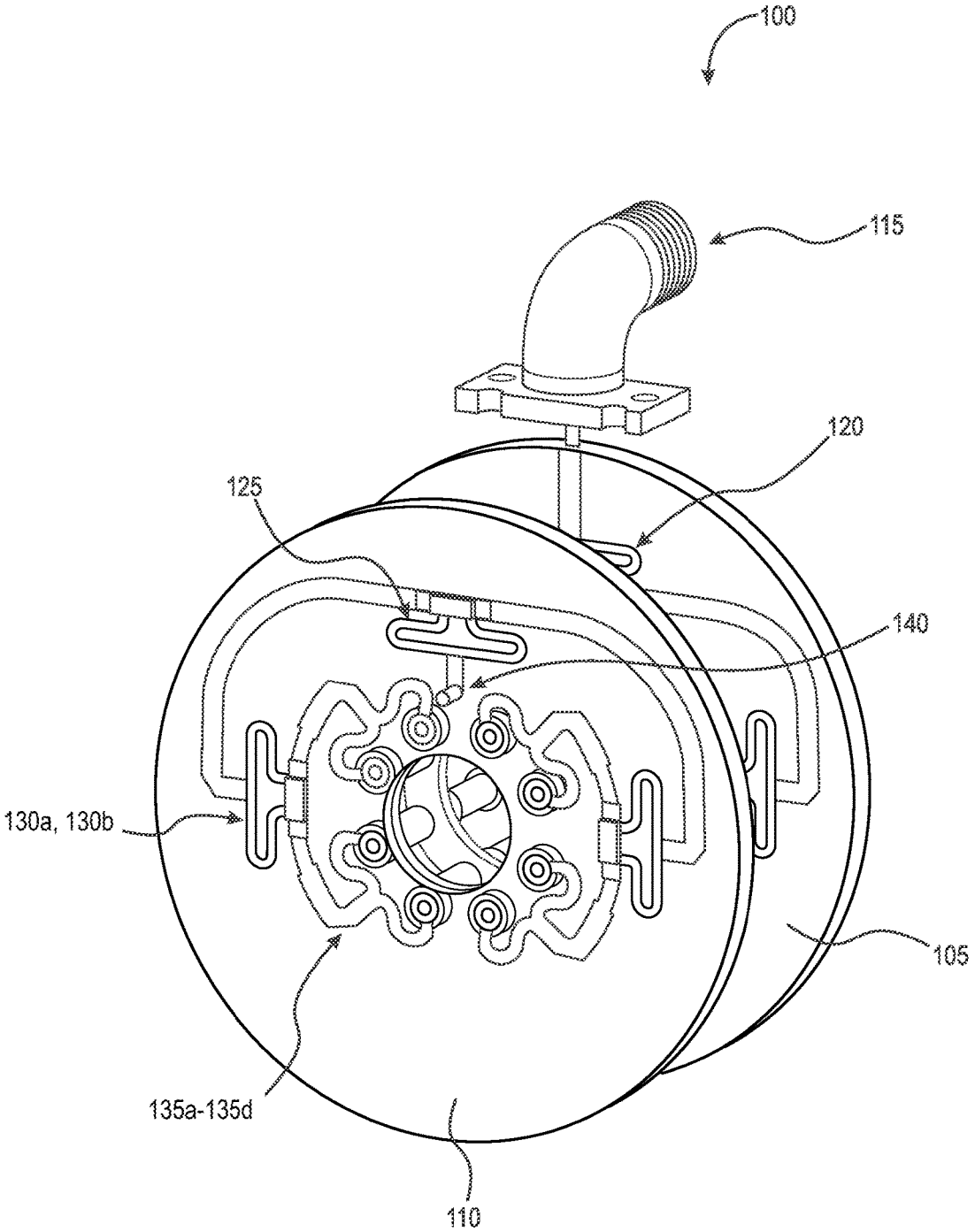
PRIOR ART Fig. 1
FIG. 1 is a schematic diagram illustrating a view of a typical radio frequency rotary coupler.
Figure 2:
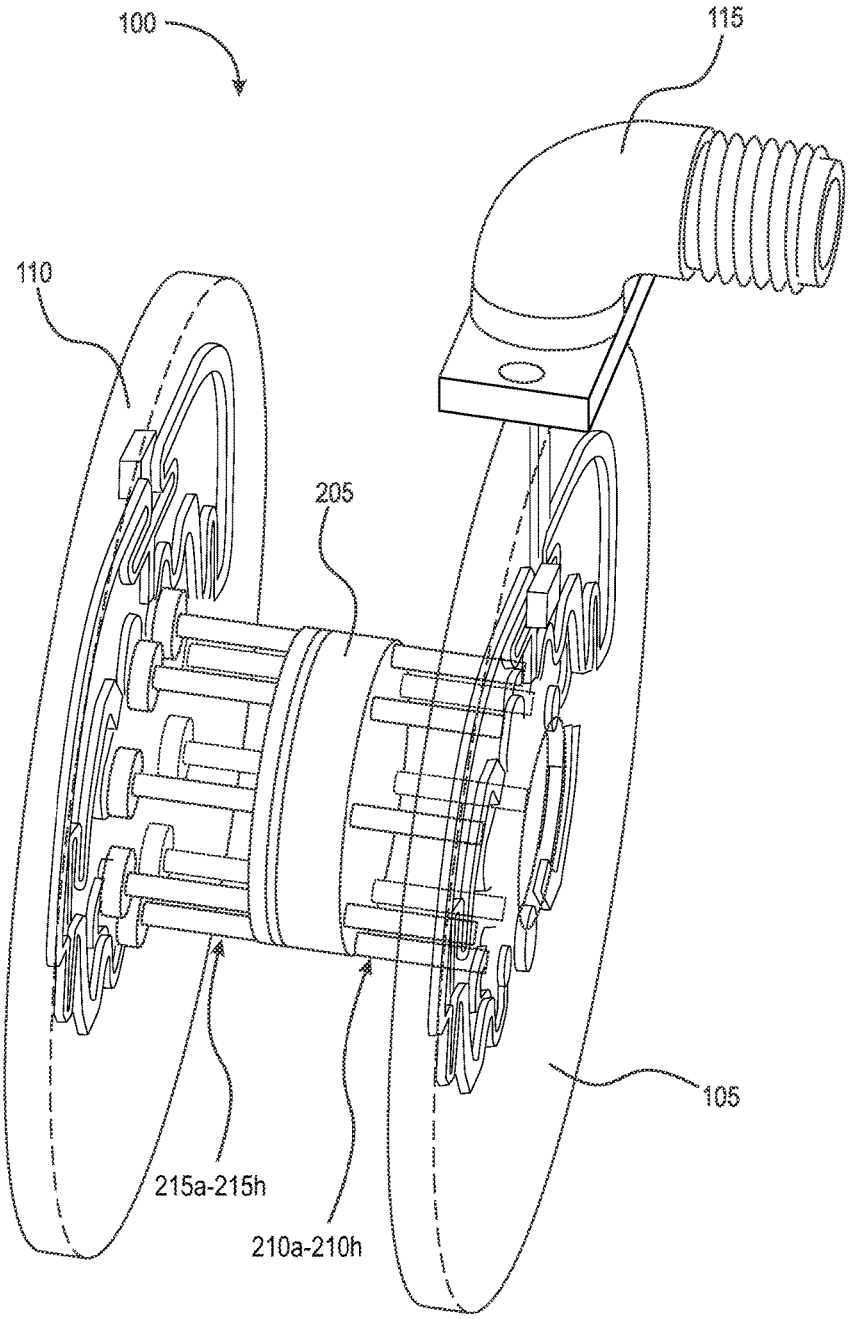
PRIOR ART Fig. 2
FIG. 2 is a schematic diagram illustrating another view of the typical radio frequency rotary coupler of FIG. 1.
Figure 3:
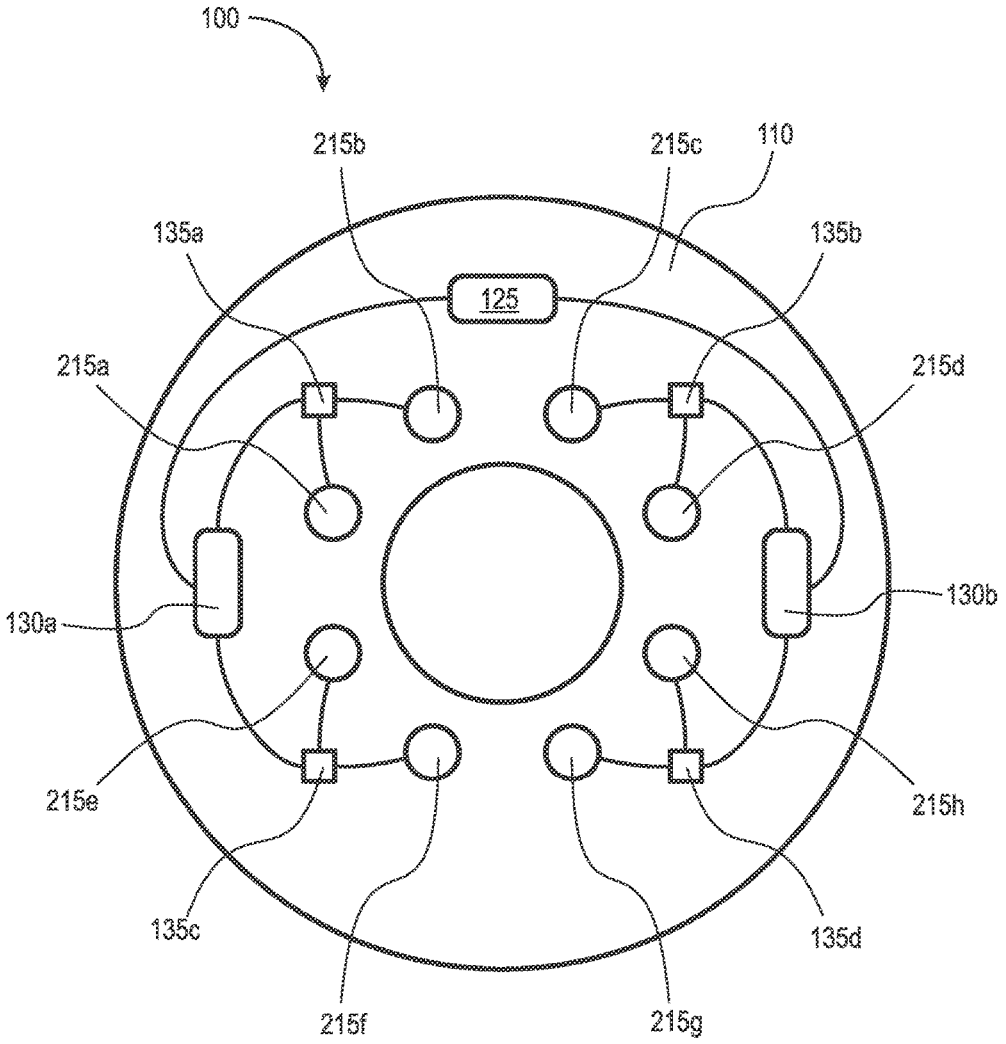
PRIOR ART Fig. 3
FIG. 3 is a simplified schematic diagram illustrating one side of the typical radio frequency rotary coupler of FIG. 1.
Figure 4:
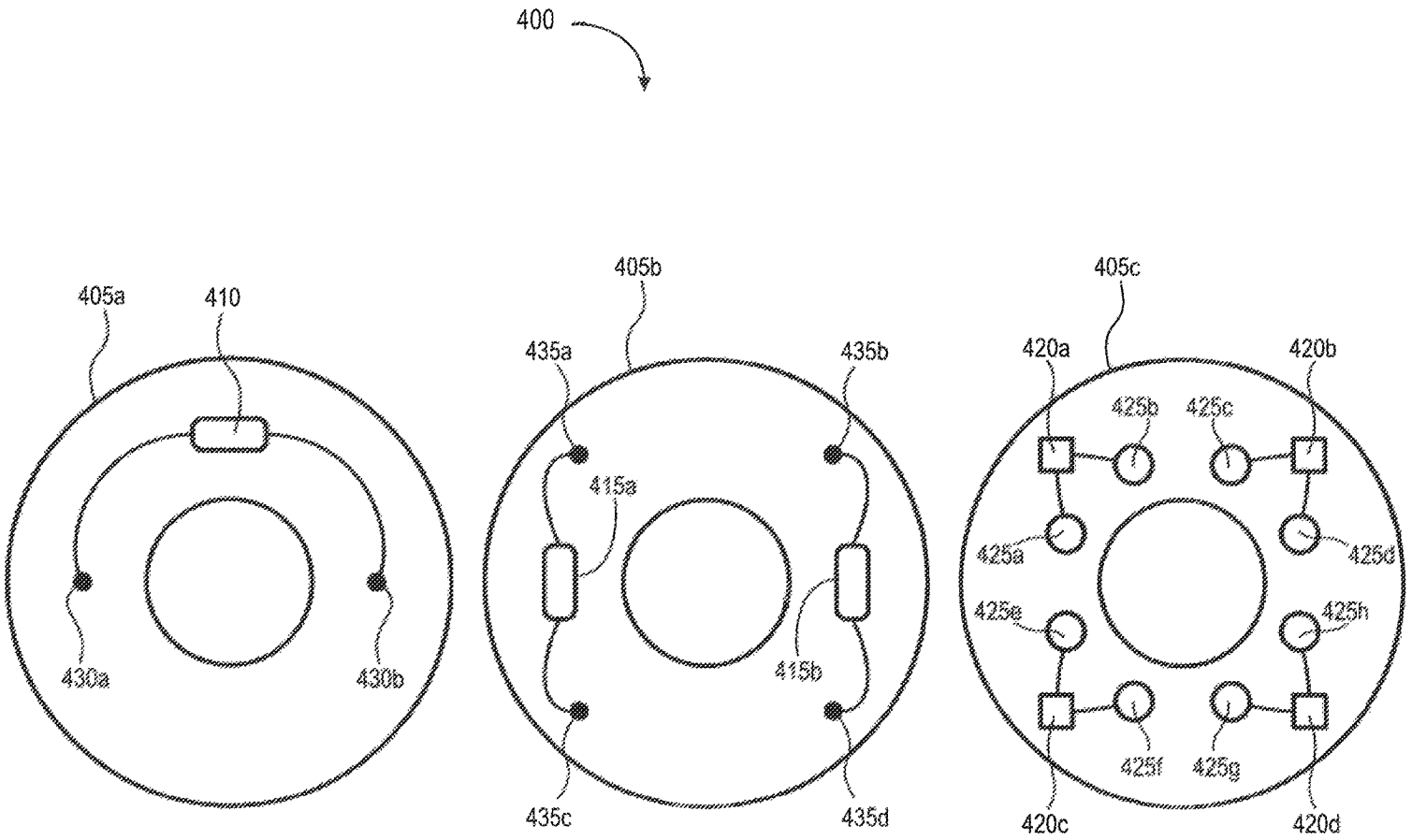
FIG. 4 is a simplified schematic diagram illustrating one side of an example radio frequency rotary coupler according to the present disclosure.

FIG. 4 is a simplified schematic diagram illustrating one side of an example radio frequency rotary coupler 400 according to the present invention. As described above, according to the concepts of the present invention, each layer of power dividers can be placed on its own circuit layer. These layers may then be axially stacked and interconnected using coaxial feeds. This architecture allows for multiple layers of circuits with minimal outside diameter. The embodiment shown in FIG. 4 includes three circuit layers 405*a*, 405*b*, and 405*c* of a stator side, for example, of the example radio frequency rotary coupler. The layers are shown unstacked for visibility. The first circuit layer 405*a* includes a primary divider 410 coupled to two coaxial feeds 430*a*, 430*b* that lead to two secondary power dividers 415*a*, 415*b*. A second circuit layer 405*b* includes the two secondary power dividers 415*a*, 415*b* coupled to four coaxial feeds 435*a*, 435*b*, 435*c*, and 435*d* that lead to four tertiary power dividers 420*a*, 420*b*, 420*c*, and 420*d*. The third circuit layer 405*c* includes the four tertiary power dividers 420*a*, 420*b*, 420*c*, and 420*d* coupled to eight coaxial feeds 425*a*, 425*b*, 425*c*, 425*d*, 425*e*, 425*f*, 425*g*, and 425*h* that lead to a dynamic capacitive ring (not shown). Each circuit layer 405*a*-405*c* includes dielectric material suitable for containing the circuit components.

Figure 5:
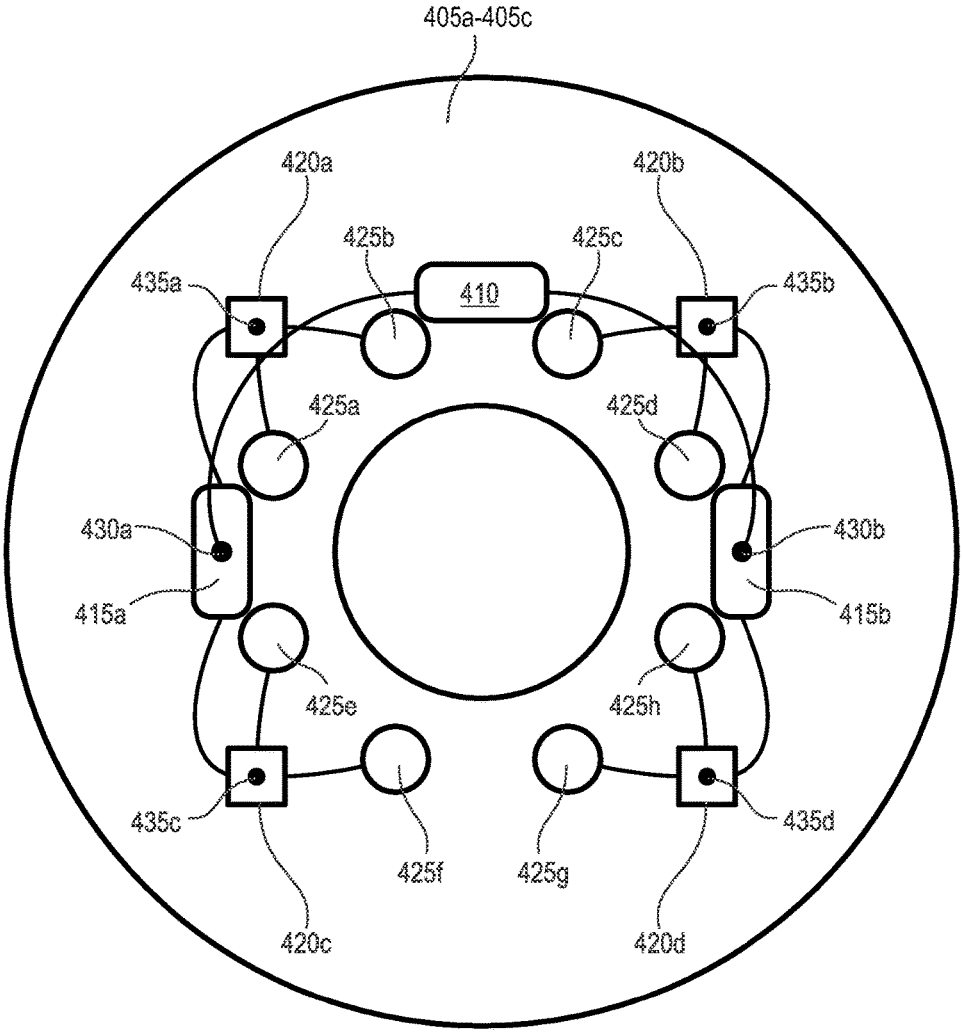
FIG. 5 is a simplified schematic diagram illustrating one side of the example radio frequency rotary coupler of FIG. 4.

FIG. 5 is a simplified schematic diagram illustrating one side of the example radio frequency rotary coupler of FIG. 4. The three layers 405*a*-405*c* are shown transparently to illustrate the overlapping arrangement of the circuit, and to show how the multi-layer approach can, thus, result in significant space savings.

Figure 6:
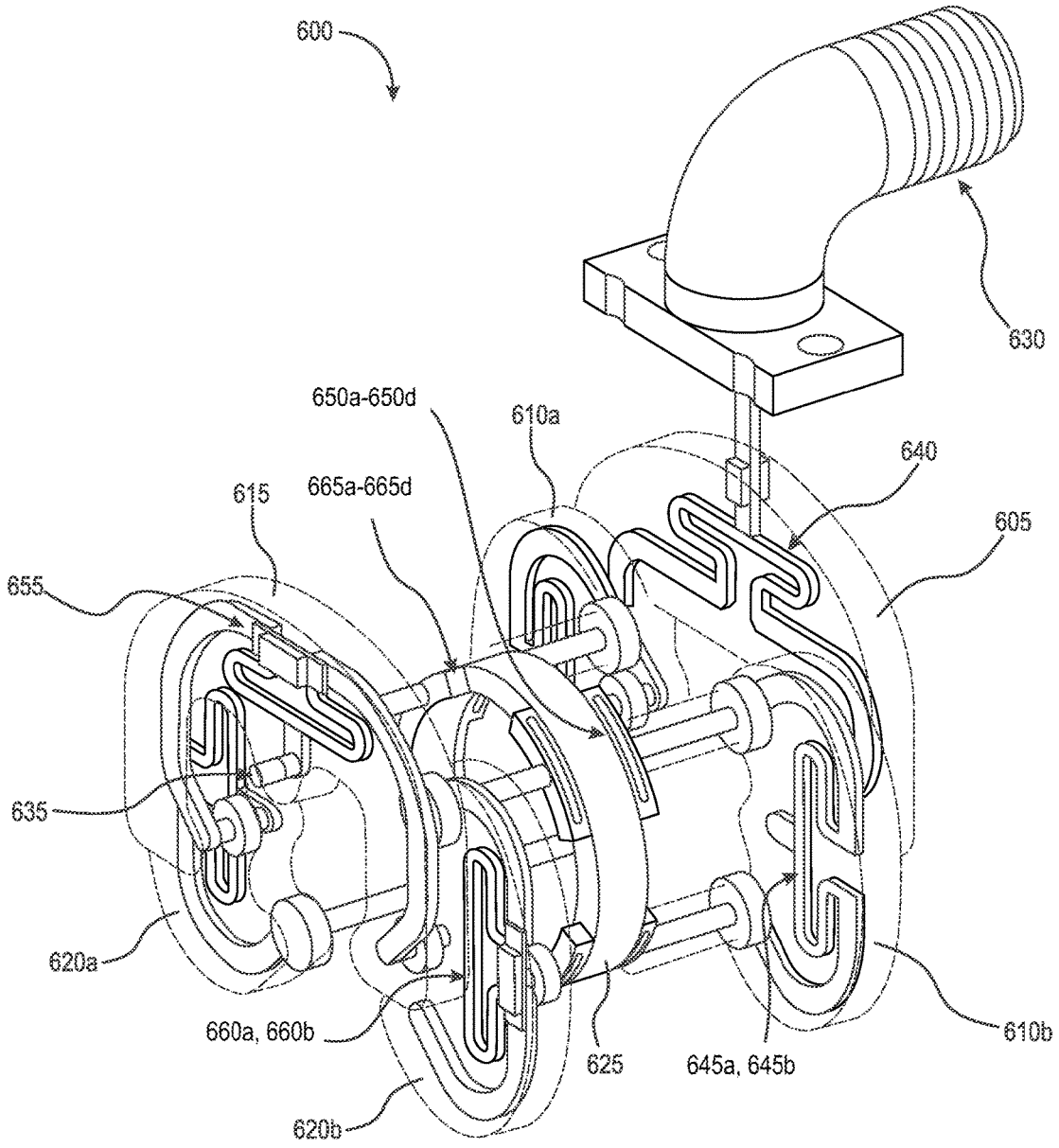
FIG. 6 is a schematic diagram illustrating a view of an example radio frequency rotary coupler according to the present disclosure.
Figure 7:
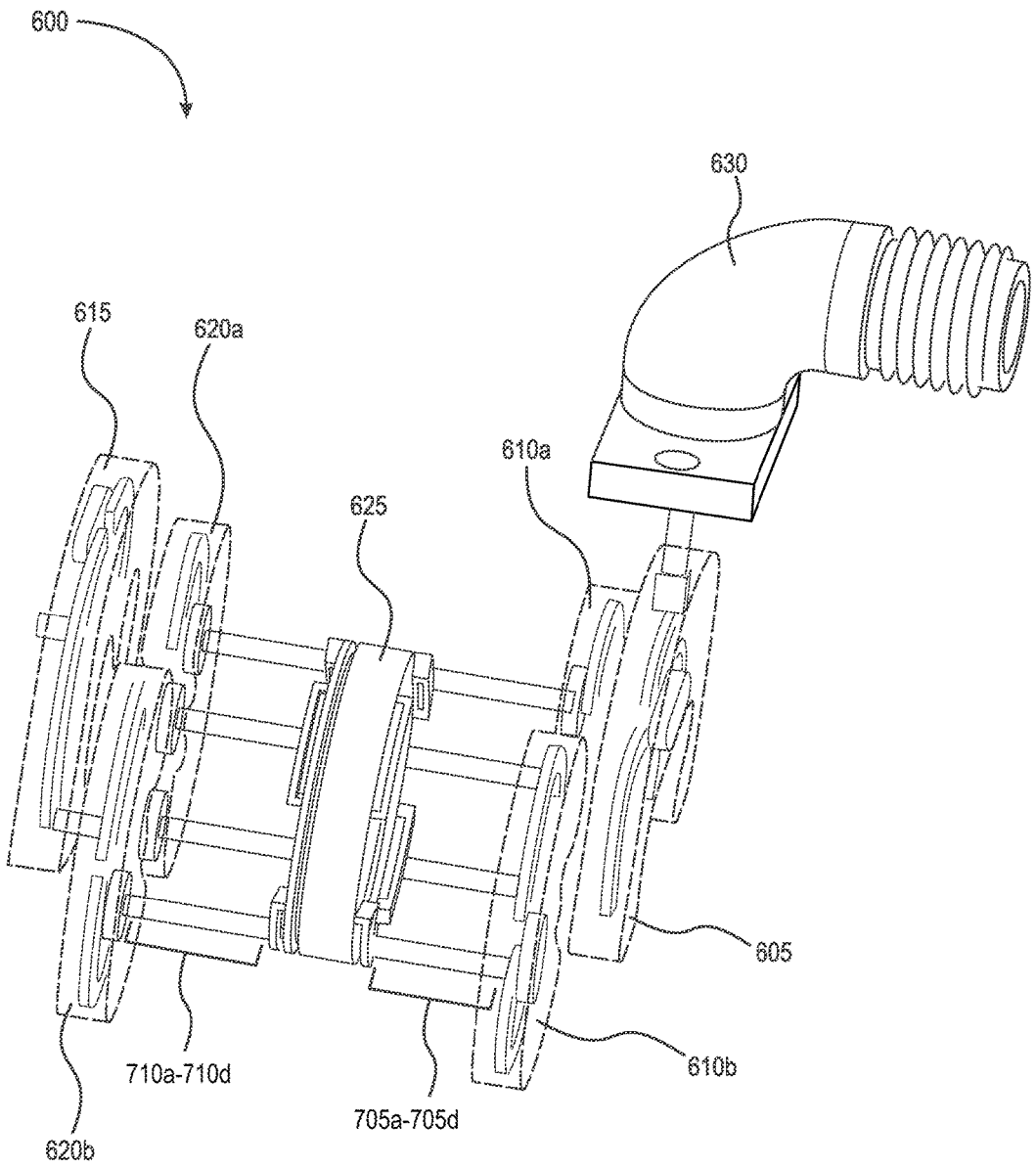
FIG. 7 is a schematic diagram illustrating another view of the example radio frequency rotary of FIG. 6.

FIG. 6 is a schematic diagram illustrating a view of an example radio frequency rotary coupler 600 according to the present invention. The illustrated rotary coupler 600 includes a stator side having a first circuit layer 605 and a two-part second circuit layer 610*a*, 610*b*. The first circuit layer 605 includes a primary power divider 640 that passes energy to the two-part second circuit layer 610*a*, 610*b*. The primary power divider 640 receives RF power from stator input 630. The two-part second circuit layer 610*a*, 610*b* includes two secondary power dividers 645*a*, 645*b* (in this example, one secondary power divider for each part of the two-part circuit layer) that pass energy to four tertiary power dividers 650*a*-650*d* via coaxial feeds 705*a*-705*d* (FIG. 7). The tertiary power dividers 650*a*-650*d* divide and pass the RF energy directly to a dynamic capacitive ring 625. The energy is then passed to four tertiary power dividers 665*a*-665*d* on the rotor side of the rotary coupler 600. The tertiary power dividers 665*a*-665*d* combine and pass the RF energy via coaxial feeds 710*a*-710*d* (FIG. 7) to two secondary power dividers 660*a*, 660*b* on a two-part second circuit layer 620*a*, 620*b* of the rotor side. The secondary power dividers 660*a*, 660*b* combine and pass the energy to a primary power divider 655 on a first circuit layer 615 of the rotor side, which passes the energy to a rotor feed 635 as output.

FIG. 7 is a schematic diagram illustrating another view of the example radio frequency rotary 600 of FIG. 6. FIG. 7 provides a better view of coaxial feeds 705*a*-705*d* and coaxial feeds 710*a*-710*d*. It should be appreciated that multiple variations of the embodiment disclosed in FIGS. 6 and 7, for example, can exist that fall within the scope of the appended claims. For example, the coupler can include any number of circuit layers, and is not limited to the embodiments having two or three layers as shown. Further, the second circuit layer (or any of the circuit layers) can be formed of a single part (as shown in FIG. 4, for example) or can include multiple parts (as shown in FIG. 6, for example). Further, the tertiary power dividers (or last-in-line power dividers for couplers with additional layers) can be coupled directly to the dynamic capacitive ring (as shown in FIG. 6, for example), or can be coupled to the ring via coaxial feeds (as shown in FIG. 4, for example).

While this invention has been particularly shown and described with references to example embodiments thereof, it will be understood by those skilled in the art that various changes in form and details may be made therein without departing from the scope of the invention encompassed by the appended claims.

What is claimed is:

1. A radio frequency rotary coupler, comprising:

a stator including:

a plurality of stator circuit layers;

a plurality of stator power dividers (SPDs), each SPD mounted on a particular one of the plurality of stator circuit layers, the plurality of SPDs including at least a primary SPD, a secondary SPD, and a tertiary SPD; and a stator coaxial feed set connecting from the primary SPD to the tertiary SPD via the secondary SPD;

wherein the plurality of stator circuit layers are stacked axially relative to a center line of rotation and interconnected using the stator coaxial feed set;

a rotor including:

a plurality of rotor circuit layers;

a plurality of rotor power dividers (RPDs), each RPD mounted on a particular one of the plurality of rotor circuit layers, the plurality of RPDs including at least a primary RPD, a secondary RPD, and a tertiary RPD; and a rotor coaxial feed set connecting from the primary RPD to the tertiary RPD via the secondary RPD;

wherein the plurality of rotor circuit layers are stacked axially relative to the center line of rotation and interconnected using the rotor coaxial feed set; and a dynamic capacitive ring coupling the stator and the rotor via the tertiary SPD and the tertiary RPD.

2. The radio frequency rotary coupler of claim 1, further comprising a stator feed connected to the primary SPD.

3. The radio frequency rotary coupler of claim 1, further comprising a rotor feed connected to the primary RPD.

4. The radio frequency rotary coupler of claim 1, wherein the plurality of stator circuit layers and the plurality of rotor circuit layers are housed within dielectric supports having an outside diameter less than one inch.

5. A radio frequency rotary coupler, comprising:

a stator including (a) a first stator circuit layer including a primary stator power divider (SPD), (b) a second stator circuit layer including at least one secondary SPD, (c) at least one tertiary SPD, (d) first stator coaxial feeds coupling the primary SPD and the at least one secondary SPD, and (e) second stator coaxial feeds coupling the at least one secondary SPD and the at least one tertiary SPD;

a rotor including (a) a first rotor circuit layer including a primary rotor power divider (RPD), (b) a second rotor circuit layer including at least one secondary RPD, (c) at least one tertiary RPD, (d) first rotor coaxial feeds coupling the primary RPD and the at least one secondary RPD, and (e) second rotor coaxial feeds coupling the at least one secondary RPD and the at least one tertiary RPD; and a dynamic capacitive ring coupling the stator and the rotor via the at least one tertiary SPD and the at least one tertiary RPD.

6. The radio frequency rotary coupler of claim 5, wherein at least the primary SPD, the at least one secondary SPD, the primary RPD, and the at least one secondary RPD are housed in dielectric supports, and wherein the at least one tertiary SPD and the at least one tertiary RPD are housed on dielectric supports.

7. The radio frequency rotary coupler of claim 6, wherein the dielectric supports housing the primary SPD and the at least one secondary SPD are stacked axially relative to the center line of rotation, and the dielectric supports housing the primary RPD and the at least one secondary RPD are stacked axially.

8. The radio frequency rotary coupler of claim 6, wherein each secondary SPD and secondary RPD is housed in a corresponding dielectric support.

9. The radio frequency rotary coupler of claim 5, further comprising a stator feed connected to the primary SPD and a rotor feed connected to the primary RPD.

10. A radio frequency rotary coupler, comprising:

a dynamic capacitive ring having a stator side and a rotor side, opposite the stator side;

a stator arranged on the stator side of the dynamic capacitive ring, the stator including (a) a first stator circuit layer including a primary stator power divider (SPD) configured to divide a single point stator feed into first and second stator outputs, (b) a second stator circuit layer displaced axially relative to a center line of rotation with respect to said first stator circuit layer, said second stator circuit layer including at least one secondary SPD configured to divide said first stator output into third and fourth stator outputs, and (c) stator coaxial feeds coupling the primary SPD and the at least one secondary SPD; and a rotor arranged on the rotor side of the dynamic capacitive ring, the rotor configured to combine and pass energy from the dynamic capacitive ring to a rotor feed as an output, the rotor including (a) a first rotor circuit layer including at least one rotor power combiner (RPC), (b) a second rotor circuit layer displaced axially relative to the center line of rotation with respect to the first rotor circuit layer, said second rotor circuit layer including another RPC, and (c) rotor coaxial feeds coupling the at least one RPC and the another RPC, wherein the dynamic capacitive ring couples the stator and the rotor.

* * * * *